United States Patent [19]

Nagel

[11] 4,120,018

[45] Oct. 10, 1978

[54] STOP, TAIL AND SIGNAL LAMP

[75] Inventor: Robert I. Nagel, Mesa, Ariz.

[73] Assignee: Dominion Auto Accessories Limited, Toronto, Canada

[21] Appl. No.: 762,865

[22] Filed: Jan. 27, 1977

[51] Int. Cl.[2] ..... F21V 5/04

[52] U.S. Cl. ..... 362/333; 362/338; 362/340

[58] Field of Search ..... 362/290, 291, 331, 332, 362/333, 335, 337, 338, 339, 340

[56] References Cited

U.S. PATENT DOCUMENTS

| | | | |
|---|---|---|---|
| 1,478,681 | 12/1923 | Soderberg | 362/339 |
| 1,986,065 | 1/1935 | Maillet | 362/339 |
| 2,831,394 | 4/1958 | Heenan | 362/337 |
| 3,524,051 | 8/1970 | Baldwin | 362/333 |

*Primary Examiner*—Samuel W. Engle
*Assistant Examiner*—Donald P. Walsh
*Attorney, Agent, or Firm*—Barnes, Kisselle, Raisch & Choate

[57] ABSTRACT

A back-up lens for a stop, tail and signal lamp comprising a body of clear plastic material having an inner surface with dioptrics and catadioptrics thereon and an outer surface with cylindrical surfaces thereon.

2 Claims, 6 Drawing Figures

STOP, TAIL AND SIGNAL LAMP

DESCRIPTION

Figure 1:
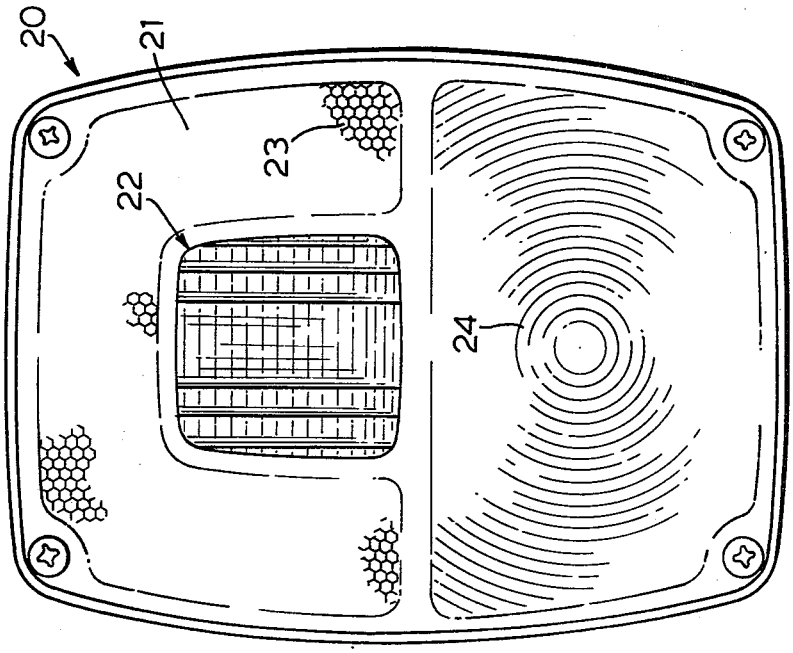
FIG. 1 is a front elevational view of a lens embodying the invention.

Referring to FIG. 1, lamp 20 conventionally comprises a housing on which a lens 21 is provided that is made of plastic and has an insert 22 therein. The lens 21 has a smooth outer surface and an upper portion including retro-reflective prisms 23 and a lower portion having dioptrics and catadioptrics 24 on the inner surface thereof.

Figure 4:
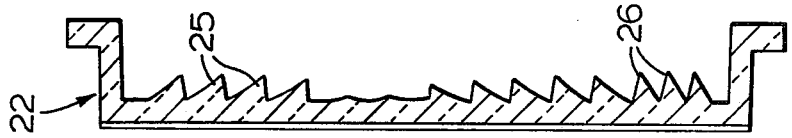
FIG. 4 is a sectional view taken along the line 4—4 in FIG. 2.
Figure 2:
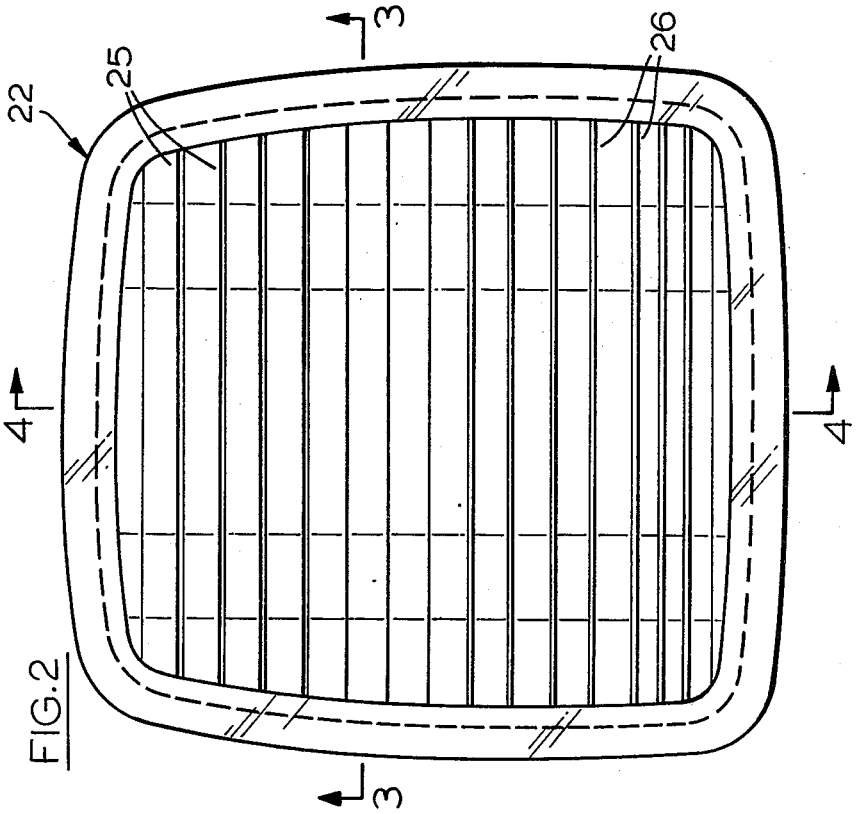
FIG. 2 is a rear elevational view of the back-up lens.
Figure 3:
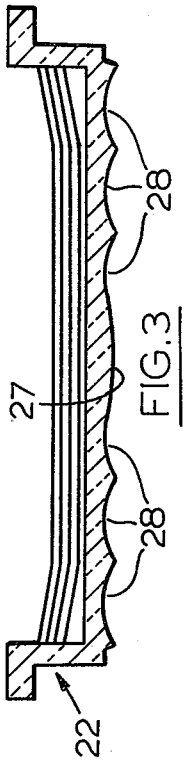
FIG. 3 is a sectional view taken along the line 3—3 in FIG. 2.

Referring to FIGS. 2–4, the back-up lens 22 comprises a body of clear plastic material, sometimes referred to as white, and has an inner surface with dioptrics 25 on the opposite sides of the center line and catadioptrics 26 below the dioptrics 25.

The body of the back-up lens 22 has an outer surface with a convex centrally located surface 27 and concave cylindrical surfaces 28.

As shown in the drawings, the lens including the back-up lens 22 is adapted to be mounted in vertical position with the dioptrics extending generally horizontally.

Figure 5:
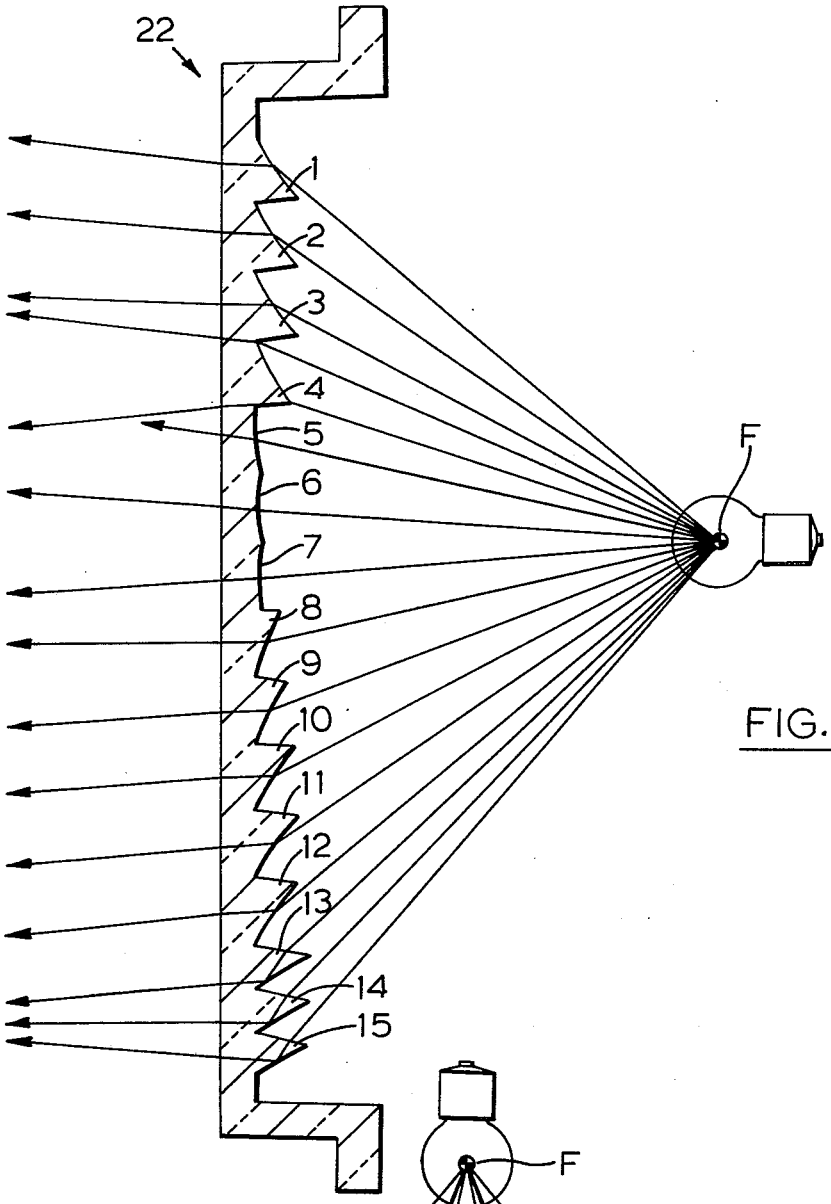
FIG. 5 is a view similar to FIG. 4 on an enlarged scale showing typical light rays.

Referring to FIG. 5, the dioptrics 25 comprise four horizontal prisms 1–4 which have concave upper surfaces, dioptrics 5, 6, 7, having concave surfaces, and dioptrics 8, 9, 10, 11, 12, with lower concave surfaces. The dioptrics function to redirect the light from the filament F toward the horizontal. The catadioptrics also extend horizontally and comprise prisms 13, 14, 15, which redirect the light from the filament by refraction and reflection toward the horizontal.

The cylindrical surface 16 functions to redirect the light in the horizontal plane toward the axis of the back-up lens 22 while the cylindrical portions 17, 18, 19 tend to direct the light in a horizontal plane to provide lateral dispersion thereof.

Figure 6:
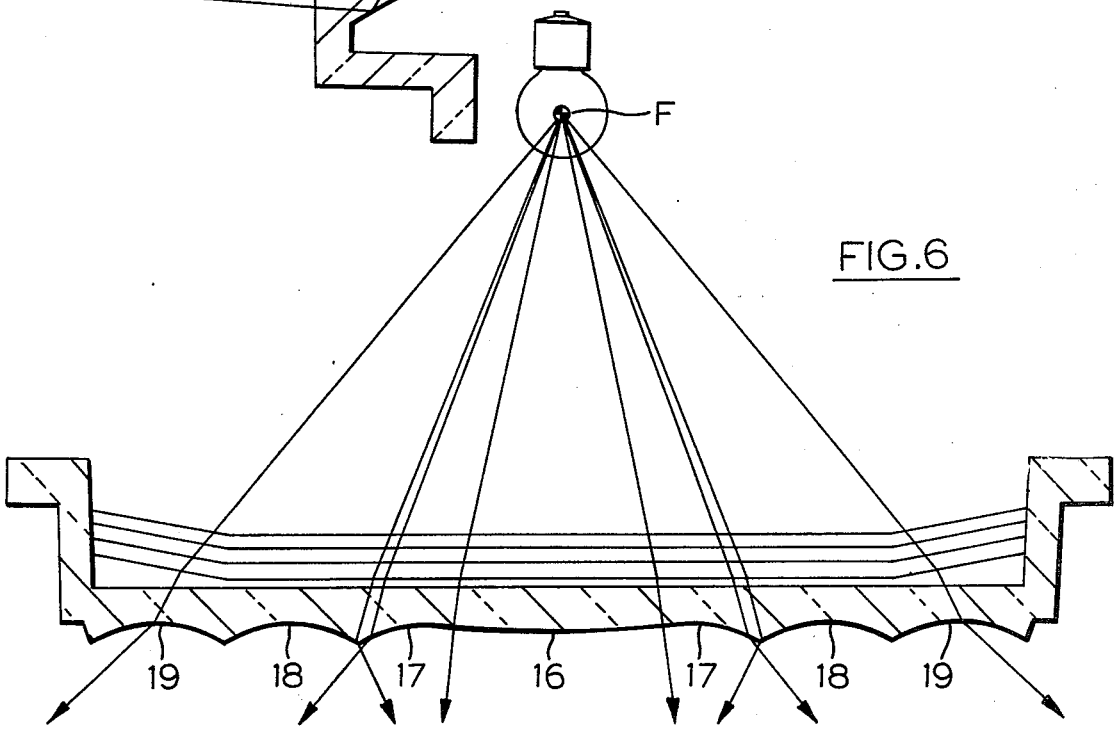
FIG. 6 is a sectional view similar to FIG. 3 on an enlarged scale showing typical light rays.

As shown in FIG. 6, the cylindrical surfaces are indicated as 16, 17, 18 and 19.

The manner in which the optics on the inner surface tend to redirect the light is shown by the following Table I:

TABLE I

| Optic | Angle of Entering Ray | Angle of Redirected Ray |
|---|---|---|
| 1 | 39.5° | 6.7° |
| 2 | 34.0° | 4.7° |
| 3 | 27.5° | 1.5° |
| 3–4 | 23.0° | 6.5° |
| 4 | 17.5° | −6.5° |
| 5 | 12.0° | 9.5° |
| 6 | 4.5° | 4.5° |
| 7 | −4.5° | −4.5° |
| 8 | −12.5° | 0° |
| 9 | −20.0° | −3.5° |
| 10 | −27.5° | −4.2° |
| 11 | −34.0° | −4.6° |
| 12 | −39.5° | −5.7° |
| 13 | −43.0° | −5.0° |

TABLE I-continued

| Optic | Angle of Entering Ray | Angle of Redirected Ray |
|---|---|---|
| 14 | −46.0° | 0° |
| 15 | −49.0° | 5.0° |

The manner in which the optics on the outer surface redirect the light is shown by the following Table II:

TABLE II

| Optic | Angle of Entering Ray | Angle of Redirected Ray |
|---|---|---|
| 16 | 12° | 6.5° |
| 17 | 21° | 40.0° |
| 18 | 22° | −26.0° |
| 19 | 40° | 48.0° |

The manner in which the back-up lens functions to meet the S.A.E. standards and the Canadian standards for minimum candle power is shown by the following Table III:

TABLE III

| Test Points Degrees | Min. Spec. Candle Power | Measured Candle Power |
|---|---|---|
| 10L | 10 | 19 |
| 10U-V | 15 | 45 |
| 10R | 10 | 19 |
| 45L | 15 | 19 |
| 10L | 20 | 54 |
| 5U-V | 25 | 91 |
| 10R | 20 | 36 |
| 45R | 15 | 25 |
| 45L | 15 | 32 |
| 30L | 25 | 68 |
| 10L | 50 | 101 |
| H-V | 80 | 166 |
| 10R | 50 | 74 |
| 30R | 25 | 65 |
| 45R | 15 | 29 |
| 45L | 15 | 25 |
| 30L | 25 | 61 |
| 10L | 50 | 104 |
| 5D-V | 80 | 170 |
| 10R | 50 | 66 |
| 30R | 25 | 59 |
| 45R | 15 | 23 |

In the above test results shown in Table III, the maximum candle power was 195 at 2.9° L., 3.5° D.

I claim:

1. A back-up lens for a stop and tail lamp which comprises a body of clear transparent material adapted to be mounted in vertical position in the lamp, said body comprising an inner surface and an outer surface and having a generally horizontal optical axis extending at a right angle to the plane thereof, said inner surface of said body having a plurality of parallel horizontally extending dioptrics above and below the optical axis of said body and a plurality of generally parallel horizontal catadioptrics below the dioptrics, at least one surface of each of said dioptrics is concave, the endmost portions of each dioptric and catadioptric are at an angle to the central portions thereof, said outer surface having a central convex cylindrical surface with the axis thereof extending generally parallel to the plane of said body and a plurality of concave cylindrical surfaces extending vertically on opposite sides of said convex cylindrical surface with the axes thereof generally parallel to the plane of said body.

2. The combination set forth in claim 1 wherein said body is in the form of an insert, a lens comprising a second body of transparent material comprising a smooth outer surface and having an opening in which said insert is placed.

* * * * *